United States Patent [19]

Judkins

[11] 4,245,446

[45] Jan. 20, 1981

[54] FUSIBLE PANEL CLIP

[75] Inventor: Thomas E. Judkins, Baltimore, Md.

[73] Assignee: Alcan Aluminum Corporation, Cleveland, Ohio

[21] Appl. No.: 924,805

[22] Filed: Jul. 14, 1978

[51] Int. Cl.[3] ..... E04C 2/00

[52] U.S. Cl. ..... 52/232; 52/1; 52/482; 52/484

[58] Field of Search ..... 52/1, 232, 482, 484, 52/489

[56] References Cited

U.S. PATENT DOCUMENTS

| | | | |
|---|---|---|---|
| 2,580,540 | 1/1952 | Graves | 52/232 |
| 3,246,432 | 4/1966 | Young, Jr. | 52/1 |
| 3,295,284 | 1/1967 | Tschiesche | 52/484 |
| 3,313,075 | 4/1967 | Buchmeier | 52/489 |
| 3,618,176 | 11/1971 | Barnes | 52/484 |
| 4,063,391 | 12/1977 | Balinski et al. | 52/1 |

*Primary Examiner*—William F. Pate, III

*Attorney, Agent, or Firm*—Maky, Renner, Otto & Boisselle

[57] ABSTRACT

A one-piece panel clip is provided which is adapted to support a plurality of elongate ceiling panels so as to form a ceiling construction. The panel clip comprises a planar support strip which mates with the under surface of a ceiling support rail and includes a series of bendable tabs spaced along each side thereof for securing the panel clip to the support rail. Depending downwardly from the elongate support strip are panel hanging portions which are formed integrally with the support strip and which are used to support the ceiling panels, the panel hanging portions being shaped to engage longitudinal flanges formed on opposite sides of the ceiling panels.

9 Claims, 2 Drawing Figures

FUSIBLE PANEL CLIP

FIELD OF THE INVENTION

The present invention relates to suspended ceilings, and, more particularly, to a panel clip used to support ceiling panels which form the exposed ceiling.

BACKGROUND OF THE INVENTION

Suspended ceilings are widely used in homes, buildings, and other structures for aesthetic and other reasons. A typical suspended ceiling comprises a plurality of ceiling panels which are spaced below the true or structural ceiling of a room and which are supported by a matrix of horizontal rails suspended from the true ceiling.

A number of prior art patents disclose a variety of suspended ceilings or walls. For example, U.S. Pat. No. 2,994,113 (Dail) discloses a ceiling construction where individual, specifically shaped clip members are adapted to hang from rails and serve to support runners. These runners carry acoustic tiles which form the ceiling. Another type of suspended ceiling is disclosed in U.S. Pat. No. 3,911,638 (Englund et al), where individual clips, received in slots in carriers, are provided with spring portions for gripping a portion of a panel. Individual springs clips have also been disclosed in U.S. Pat. No. 2,591,361 (Knott). In this patent, the spring clip is slidably held in a furring strip and has resilient tabs to grip the wall panel. A multiple panel carrying carrier for sound proof walls is disclosed in U.S. Pat. No. 3,313,075 (Buchmeier). The carrier disclosed in this patent is slidably received between a pair of guide rails and is held in a tubular connecting portion of the guide rail by an arcuate end portion formed along one edge of the carrier. The other edge of the carrier includes a series of C-shaped noses for supporting C-shaped panels.

It will, of course, be understood that the patents discussed above are not represented to be exhaustive of the prior art. Moreover, no representation is being made that no closer prior art exists.

SUMMARY OF THE INVENTION

The present invention provides a novel one-piece panel clip which designed to support a plurality of ceiling panels. The panel clip basically comprises an elongate planar support strip with a plurality of bendable tabs located along each side edge thereof for easily and positively securing the panel clip to a support rail and a plurality of panel hanging portions which depend from each side edge of the elongate strip and are used to support the ceiling panels.

The panel clip of the invention is extremely simple and easy to manufacture with all parts thereof being formed from a single piece of stock material. The clip is adapted to support a plurality of panels and inherently provides equal spacing of the panels supported thereby. A ceiling assembly constructed in accordance with the present invention is easily and quickly installed, the individual panel clips being readily and rapidly attachable to corresponding support rails by means of bendable tabs referred to above.

In accordance with a preferred embodiment of the invention, the panel clip is fabricated from a readily fusible material. In the event of a serious fire, the panel clip readily melts, so that the panels supported thereby will fall from the ceiling exposing the fire directly to a fire resistive membrane. By fabricating the panel clip from a material whose melting point is much lower than the support rails, the support rails for the ceiling can remain in place so that the clips provide a "failsafe" effect.

Other features and advantages of the present invention will be set forth in, or apparent from, the detailed description of the presently preferred embodiments of the invention found hereineblow.

DETAILED DESCRIPTION OF THE PREFERRED EMBODIMENTS

Figure 1:
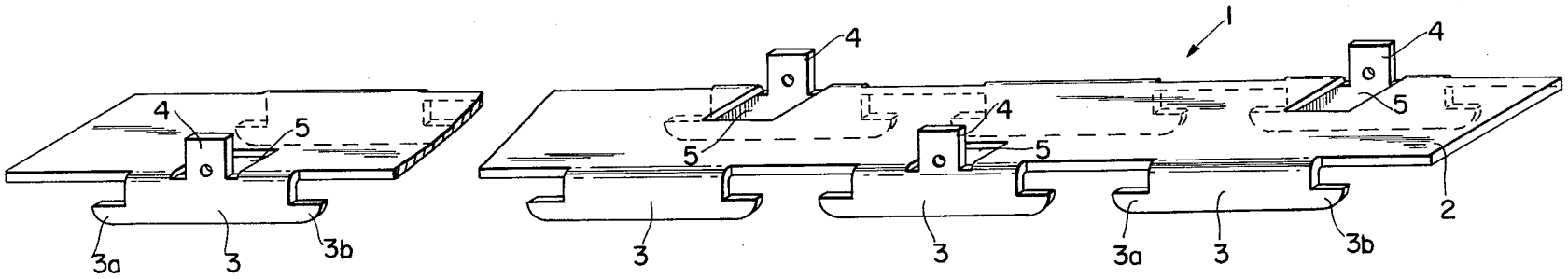
FIG. 1 is a perspective view of a presently preferred embodiment of the present invention.

Referring to the drawings in which like numerals represent like elements throughout the several views, a presently preferred embodiment of the panel clip of the invention is depicted in FIG. 1. The panel clip, which is generally denoted 1, comprises a central elongate strip 2 which is essentially planar or flat. Depending from both longitudinal sides of elongate strip 2 are panel hanging portions 3. These panel hanging portions 3 are evenly spaced along the length of the elongate strip 2 on both sides thereof. In the preferred embodiment illustrated, the hanging portions 3 are located in opposed pairs along the sides. However, it would be possible to provide panel hanging portions in an alternating pattern with one hanging portion, in sequence, depending from one side and then the next depending from the other side and so on, rather than arranging the opposed portions as pairs. The hanging portions 3 each include laterally extending flanges 3*a* and 3*b*, which adapted to engage reciprocally shaped, longitudinally extending flanges of ceiling panels as described hereinbelow in connection with FIG. 2.

A series of bendable support tabs 4 are also located along each longitudinal side of the elongate strip 1. In the preferred embodiment under consideration, tabs 4 are provided in an alternating pattern with one, in the series, on one side, the next on the other side, and so on. Tabs 4 are located in the middle of the corresponding hanging portions 3. To provide additional support, opposed tabs 4 could be utilized. To facilitate bending of the individual tabs 4 out of the plane of strip 2, an aperture or cut out 5 is provided in strip 2, around the tabs 4.

Figure 2:
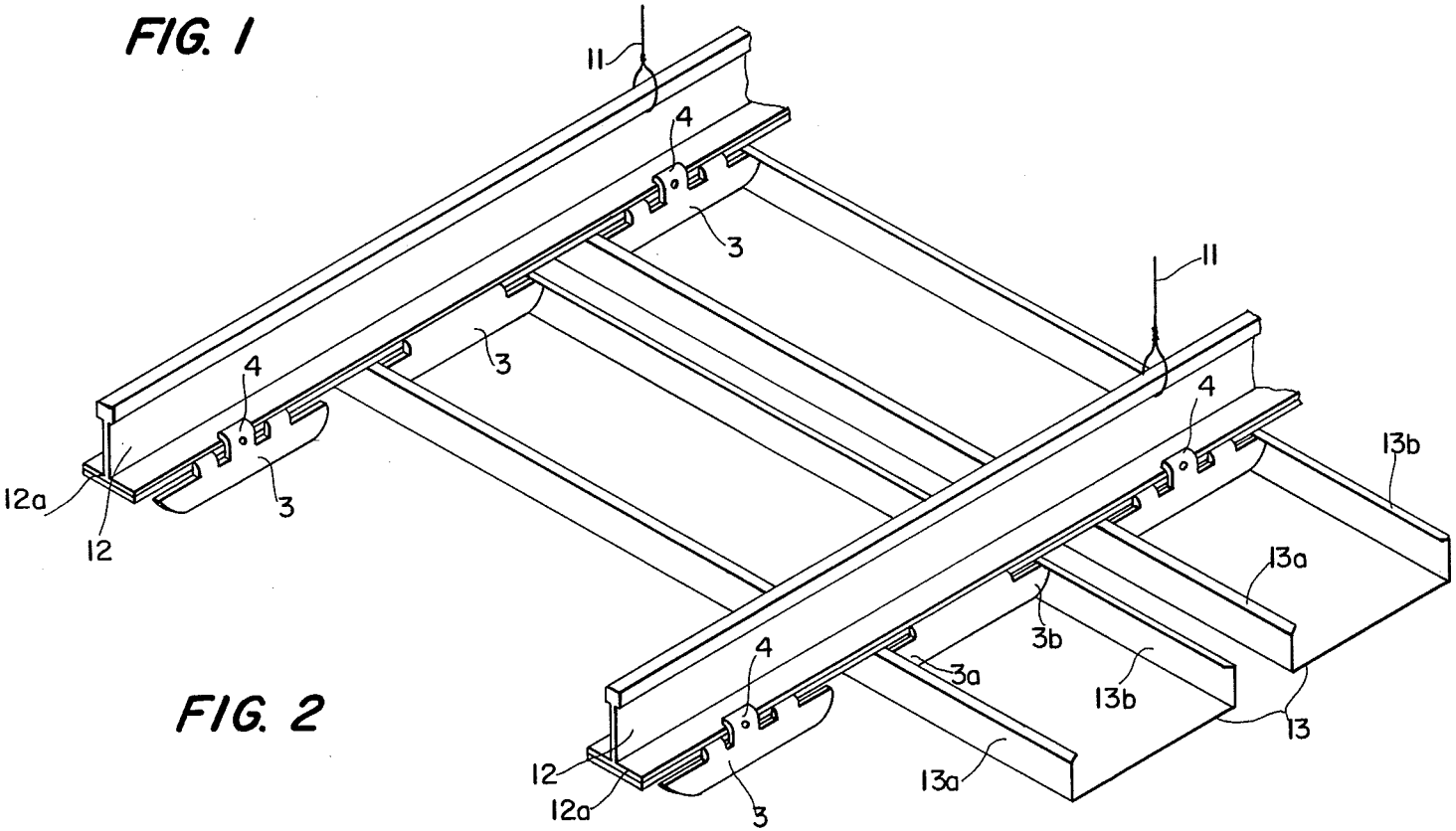
FIG. 2 is a perspective view of the ceiling assembly embodying the present invention.

Referring to FIG. 2, a ceiling assembly is illustrated which is supported from the true ceiling or superjacent structure by suitable means, such as wires 11. Wires 11 support a plurality of elongate support rails 12 in a spaced, parallel arrangement. The support rails comprise I-beams whose base flanges 12*a* lie in a common plane.

In the use of the panel clips of the invention, the planar central support strips 2 of the clips 1 are brought into mating relationship with the bottom surface of the base flange 12*a* of the support rails 12 and the clips 1 are quickly and positively secured to the support rails 12 by means of the bendable tabs 4 which are bent around the flanges 12*a* of support rails 12. A plurality of ceiling panels 13 are suspended in spaced parallel relation beneath the rails 12 by means of the hanging portions 3 of clips 1. Panels 13 extend transversely to support rails 12 and include longitudinally extending flanges 13*a*, 13*b* which are engaged by flanges 3*a* and 3*b* of clips 1.

It will be understood that the actual shape of the face of the hanging portions 3 will depend upon the cross-sectional shapes of the panels 13 and in particular, on the shapes of flanges 13*a*, 13*b*. Similarly, the width of the support strips 2 of the panel clips 1 can be adapted to provide for suitable mating with the support rails 12. The length of tabs 4 will also be determined by the shape and size of the engaging surfaces of the flanges of the support rails 12. Further, elongate ribs or other deformations can be punched into the mating surfaces of the elongate strips 2 of panel clips 1 to provide for greater resistance to bending.

The ease of manufacture and installation of the panel clips of the invention should be readily apparent from the foregoing description. The panel clips of the invention are preferably made from a flat elongate sheet of sheet metal by first punching away portions of the sheet, including portion 5, to form both the hanging portions 3 and the tabs 4. The hanging portions 3 are then bent downwardly from the central strip 2, which action will also bring the bendable tabs 4 up from the plane of the strip 2. As used in constructing a ceiling, the panel clip 1, is cut into convenient lengths such as 4", 8", 12", or 16", and is quickly and easily attached to support rails 12 by merely placing a panel clip 1 below a rail 12 and bending tabs 4 onto the rail 12, as described hereinbefore. Because the panel clip 1 is resiliently, albeit firmly, held onto rail by tabs 4, a sufficient force exerted on the panel clip will only result in the panel clip being separated from the rail 12, rather than having the rail pulled down as well. Of course, if required, a panel clip 1 can also be easily removed from a rail 12 by bending back the tabs 4 toward their original positions.

In the preferred embodiment, the panel clip 1 is made from a material with a relatively low melting point in relation to the melting point of the support rail 12. Various alloys of aluminium and other materials would be suitable for this purpose. Thus, in the event of a fire, the panel clip would readily melt. This would allow those panels nearest the fire to fall down exposing the fire to a fire resistive membrane which itself is designed to contain the fire for a given time period to that specific area. In addition, only those panel clips nearest the fire would melt and release the panels, while the support rails and the rest of the panels would remain in place. It is also possible for a fire to start between the hanging ceiling and the true ceiling. Such a fire may, for example, be caused by electrical wires located there, and determining the location of the fire could be difficult. However, with "fusible" panel clips such as provided in accordance with the invention, the panels 13 would quickly fall away from the area adjacent the fire making the fire easier to locate and put out.

Although the invention has been described in detail with respect to exemplary embodiments thereof, it will be understood by those of ordinary skill in the art, that variations and modifications may be effected within the scope and spirit of the invention.

I claim:

1. In combination with a support rail for supporting ceiling panels, a one-piece panel clip for supporting a plurality of elongate panels, said panel clip comprising:

a central, elongate strip which engages the bottom surface of the support rail along the length of the support rail;

means, comprising at least three bendable tabs formed integrally with said strip and located in spaced relationship along both sides of said strip, for resiliently holding said elongate strip in a mating position along the bottom surface of the support rail; and means, compising at least three evenly spaced panel hanging portions formed integrally with said strip and extending outwardly from both of the sides of said strip, for supporting a plurality of elongate ceiling panels, said clip being made of a material with a melting point substantially below that of the support rail such that said clip, upon exposure to fire, will disengage from the support rail.

2. A panel clip as claimed in claim 1 wherein said hanging portions are provided as opposed pairs on each side of said elongate strip, are cut out from said strip and are disposed centrally of alternate ones of said panel hanging portions.

3. A panel clip as claimed in claim 1 wherein said bendable tabs are provided in an alternating, longitudinal spaced pattern on each side of said elongate strip.

4. A panel clip as claimed in claim 2 wherein said bendable tabs are provided as opposed pairs on each side of said elongate strip.

5. A panel clip as claimed in claim 1 wherein said hanging portions, in use, depend downwardly from said strip and comprise laterally extending flanges for engaging reciprocally shaped, longitudinally extending flanges of the elongate panels.

6. A ceiling assembly comprising:

a plurality of spaced, parallel, elongate rails;

means for suspending said rail, substantially in a common plane, from a superjacent structure;

an array of elongate panels disposed in horizontal plane and extending in spaced parallel relation to each other beneath, and transversely of, said rails;

a plurality of fusible, one-piece panel clips with a melting point substantially below the melting point of said rails supporting said panels from said rails such that said clips, upon exposure to fire, will disengage from the support rail, each said panel clip comprising a central, elongate, generally planar strip which engages the underside of a said rail, at least three bendable tabs, formed integrally with said strip and located on opposite sides of said strip, for resiliently holding said elongate strip in mating relationship with said rail, and at least three evenly spaced panel hanging portions formed integrally with said strip on opposite sides thereof and depending downwardly from opposite sides of said strip, for supporting said array of elongate panels.

7. A ceiling assembly as claimed in claim 6 wherein said bendable tabs are provided in an alternating longitudinally spaced pattern on each side of said elongate strip and are cut out from said strip.

8. A ceiling assembly as claimed in claim 5 wherein said bendable tabs are provided as opposed pairs on each side of said elongate strip.

9. A ceiling assembly as claimed in claim 5 wherein said hanging portions are provided as opposed pairs on each side of said elongate strip.

* * * * *